US007071634B2

(12) United States Patent
Johnson et al.

(10) Patent No.: US 7,071,634 B2
(45) Date of Patent: Jul. 4, 2006

(54) LIGHTING CONTROL DEVICE HAVING IMPROVED LONG FADE OFF

(75) Inventors: Benjamin Aaron Johnson, Quakertown, PA (US); Glen Andrew Kruse, Lansdale, PA (US); Jon Michael Keagy, Perkasie, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 5 days.

(21) Appl. No.: 10/753,035

(22) Filed: Jan. 7, 2004

(65) Prior Publication Data

US 2005/0146288 A1 Jul. 7, 2005

(51) Int. Cl.
*G05F 1/00* (2006.01)

(52) U.S. Cl. ..... 315/297; 315/292; 315/293; 315/291; 315/307; 315/360

(58) Field of Classification Search ..... 315/292–295, 315/297, 307, 312, 314, 320, 321, 362, 194, 315/DIG. 4, 360
See application file for complete search history.

(56) References Cited

U.S. PATENT DOCUMENTS

| | | | | |
|---|---|---|---|---|
| 4,649,323 | A | 3/1987 | Pearlman et al. | 315/307 |
| 5,059,871 | A * | 10/1991 | Pearlman et al. | 315/316 |
| 5,248,919 | A | 9/1993 | Hanna et al. | 315/291 |
| 5,399,940 | A | 3/1995 | Hanna et al. | 315/129 |
| 5,463,286 | A * | 10/1995 | D'Aleo et al. | 315/295 |
| 5,621,283 | A * | 4/1997 | Watson et al. | 315/362 |
| 6,169,377 | B1 * | 1/2001 | Bryde et al. | 315/294 |
| 6,300,727 | B1 | 10/2001 | Bryde et al. | 315/294 |
| 6,380,696 | B1 | 4/2002 | Sembhi et al. | 315/294 |
| 2002/0060530 | A1 | 5/2002 | Sembhi et al. | 315/291 |

FOREIGN PATENT DOCUMENTS

| | | |
|---|---|---|
| EP | 1 104 979 A2 | 6/2001 |
| JP | 08/185986 | 7/1996 |

* cited by examiner

*Primary Examiner*—Haissa Philogene
(74) *Attorney, Agent, or Firm*—Woodcock Washburn LLP

(57) ABSTRACT

A lighting control device for controlling the light intensity level of at least one lamp is disclosed. The lighting control device includes a microcontroller and a user-actuatable switch controller that is operatively coupled to the microcontroller. The microcontroller causes the light intensity level of the lamp to fade at a first fade rate when the switch controller is actuated. If the microcontroller determines that the switch controller has been actuated for at least a predefined actuator hold time, the microcontroller causes the light intensity level of the lamp to fade at a second fade rate for a predefined long fade time. After the long fade time elapses, the microcontroller causes the light intensity level of the lamp to fade to off at a third fade. The first fade rate is based on a predefined fade-off time that represents a time allotted for fading the light intensity level of the lamp from its initial light intensity level to off. To prevent the light intensity level from fading to off before the actuation time elapses, the fade off time may be defined to be longer than the actuation time. The second fade rate may be slower than the first fade rate and have an exponential fade profile. The third fade rate may be a predefined rate at which the microcontroller is programmed to cause the light intensity level to fade from full on to full off. The third fade rate may be quicker than the second fade rate.

78 Claims, 10 Drawing Sheets

LIGHTING CONTROL DEVICE HAVING IMPROVED LONG FADE OFF

FIELD OF THE INVENTION

The invention relates generally to lighting control devices. More particularly, the invention relates to lighting control devices that employ a sequence of fade rates to fade the light intensity level of one or more lamps.

BACKGROUND OF THE INVENTION

Dimmer switches, i.e., wall-mounted light switches that include a dimmer, have become increasingly popular, especially for applications where it is desired to control precisely the level of light intensity in a particular room. Some known dimmer switches employ a variable resistor that is manipulated by hand to control the switching of a triac, which in turn varies the voltage input to the lamp(s) to be dimmed. Such manually-operated, variable resistor dimmer switches have a number of known limitations. There exist touch actuator controls that address at least some of these limitations.

One such touch actuator control cycles repetitively through a range of intensities from dim to bright in response to extended touch inputs. A memory function is provided such that, when the touch input is removed, the cycle will be stopped and the level of light intensity at that point in the cycle will be stored in a memory. A subsequent short touch input will turn the light off, and a further short touch input will turn the light on at the intensity level stored in the memory. While this type of switch is an improvement over manually-operated variable resistor dimmer switches, it requires the user to go through the cycle of intensity levels in order to arrive at a desired intensity level. In addition, it still lacks the ability to return to a desired intensity level after having been set to full light output. A user must go through the cycle again until he or she finds the light intensity level desired. Moreover, this type of switch typically has no ability to perform certain aesthetic effects such as a gradual fade from one light intensity level to another.

U.S. Pat. No. 5,248,919 ("the 919 patent") discloses a lighting control that may include user-actuatable intensity selecting means for selecting a desired intensity level between a minimum intensity level and a maximum intensity level, and control switch means for generating control signals representative of preselected states and intensity levels in response to an input from a user. The disclosure of the 919 patent is incorporated herein in its entirety.

The 919 patent further discloses control means for causing at least one lamp to fade: a) from an off state to the desired intensity level, at a first fade rate, when the input from a user causes a switch closure; b) from any intensity level to the maximum intensity level, at a second fade rate, when the input from a user causes two switch closures of transitory duration in rapid succession; c) from the desired intensity level to an off state, at a third fade rate, when the input from a user causes a single switch closure of a transitory duration; and d) from the desired intensity level to an off state, at a fourth fade rate, when the input from a user causes a single switch closure of more than a transitory duration. The control means may cause the lamp to fade from a first intensity level to a second intensity level at a fifth fade rate when the intensity selecting means is actuated for a period of more than transitory duration.

FIG. 1 depicts a prior art wall control 10 as described in the 919 patent. As shown, wall control 10 comprises a cover plate 12, an intensity selection actuator 14 for selecting a desired level of light intensity of a lamp or lamps controlled by the device, and a control switch actuator 16. Actuation of the upper portion 14*a* of actuator 14 increases or raises the light intensity level, while actuation of lower portion 14*b* of actuator 14 decreases or lowers the light intensity level. Wall control 10 may also include an intensity level indicator in the form of a plurality of light sources 18, which may be light-emitting diodes (LEDS), for example. By illuminating a selected one of light sources 18, the position of the illuminated light source within the array may provide a visual indication of the light intensity level of the lamp or lamps being controlled.

Example fade rates and fade rate profiles illustrated in the 919 patent are reproduced as FIGS. 2A–2D hereof. FIG. 2B illustrates a first fade rate, at which a lamp fades up from an off state to a desired intensity level. The first fade rate from "off" to a desired intensity level is labeled with reference numeral 40. FIG. 2B illustrates the fade rate in terms of a graph of normalized light intensity level, from "off" to 100%, vs. time, given in seconds. As shown, fade rate 40 may fade from "off" to 100% in about 3.5 seconds, i.e., at the rate of about +30% per second. This fade rate is used when the lighting control device 10 of the invention receives as a user input a single tap of the control switch actuator 16 and the lamp under control was previously off. This fade rate may, but need not, also be used when a user selects a desired intensity level by actuating intensity selection actuator 14. Thus, the lamp 20 will fade up from one intensity level to another at fade rate 40 when upper portion 14*a* of actuator 14 is actuated by the user.

Similarly, FIG. 2C illustrates a fade rate 42 at which lamp 20 will fade down from one intensity level to another when actuator 16 is tapped when the lamp under control is already on or lower portion 14*b* of actuator 14 is actuated by the user. Fade rate 42 is illustrated as being the same as fade rate 40, but with opposite sign, and fades down from 100% to "off" in about 3.5 seconds, for a fade rate of about 30% per second. However, it will be understood that the precise fade rates are not crucial, and that fade rates 40 and 42 can be different.

FIG. 2A illustrates a second fade rate 44 at which lamp 20 fades up to 100% when the lighting control device 10 receives as a user input two quick taps in succession on control switch actuator 16. As noted above, two quick taps on actuator 16 cause lamp 20 to fade from its then-current light intensity level to 100%, or full on. Fade rate 44 may be substantially faster than first fade rate 40, but not so fast as to be substantially instantaneous. An example fade rate 44 is about +66% per second. If desired, the fade rate 44 can be initiated after a short time delay, such as 0.3 seconds, or can, in that interval, be preceded by a slower fade rate 46.

A "hold" input at actuator 16 causes lamp 20 to fade from its then-current intensity level to off at a third fade rate 48, as shown in FIG. 2D. Fade rate 48 may be substantially slower than any of the previously illustrated fade rates. Fade rate 48 also may not be constant, but may vary depending upon the then-current intensity level of lamp 20. However, the fade rate may be such that the lamp 20 will fade from its then-current intensity level to off in approximately the same amount of time for all initial intensity levels. For example, if lamp 20 is desired to fade to off in about ten seconds (to give the user time to cross a room before the lights are extinguished, for example), a fade rate of about 10% per second may be used if the then-current intensity level of the lamp 20 is 100%.

On the other hand, if the then-current intensity level of lamp 20 is only 35%, the fade rate may be only 3.5% per second, so that the lamp 20 will not reach full off until the desired ten seconds. In addition, if desired, a slightly faster fade rate 50 may be used in the initial half-second or so of fadeout, in order to give the user immediate feedback to confirm that the fadeout has been initiated. A suitable fade rate 50 may be on the order of 33% per second. A similarly more rapid fade rate 52 may also be used near the very end of the fadeout, so that the lamp 20 be quickly extinguished after fading to a low level. Thus, after about ten seconds of fadeout, at a relatively slow rate, the lamp 20 will fade the rest of the way to off in about one more second. If the fast initial and final fade rates are used, then the intervening fade rate must be slowed down to achieve the same fade time.

As illustrated in FIG. 2D, however, with lower initial intensity levels, the intervening fade rate may be zero (constant light output), and with even lower initial intensity levels, the lamp may fade off during the initial fast fade. Thus, at low light intensities (e.g., less than about 20%), the control means tends to turn off the lamp before the long fade off is activated (i.e., before detection that the single switch closure is of more than a transitory duration). It would be desirable if such light controls were capable of activating a long fade off from any light intensity.

SUMMARY OF THE INVENTION

The invention is directed to lighting control devices that cause the light intensity level of at least one lamp to fade at a first fade rate based on its initial intensity upon a determination that a switch controller has been actuated. In example embodiments, the lighting control device may include a microcontroller and a user-actuatable switch controller that is operatively coupled to the microcontroller.

The microcontroller causes the light intensity level of at least one lamp to fade at a first fade rate when the switch controller is initially actuated. If the microcontroller determines that the switch controller has been actuated for at least a predefined actuation time, the microcontroller causes the light intensity level of the at least one lamp to fade at a second fade rate for a predefined long fade time.

The first fade rate is based on a predefined fade-off time that represents a time allotted for fading the light intensity level of the at least one lamp from its initial light intensity level to zero. To prevent the light intensity level from fading to off before the actuation time elapses, the fade off time may be defined to be longer than the actuation time. The second fade rate may be slower than the first fade rate, and may have an exponential fade profile.

After the long fade time elapses, the microcontroller causes the light intensity level of the at least one lamp to fade to off at a third fade rate. The third fade rate may be a predefined rate at which the microcontroller causes the light intensity level to fade from 100% to zero.

BRIEF DESCRIPTION OF THE DRAWINGS

In the drawings, wherein like numerals indicate like elements.

DETAILED DESCRIPTION OF ILLUSTRATIVE EMBODIMENTS

Figure 1:
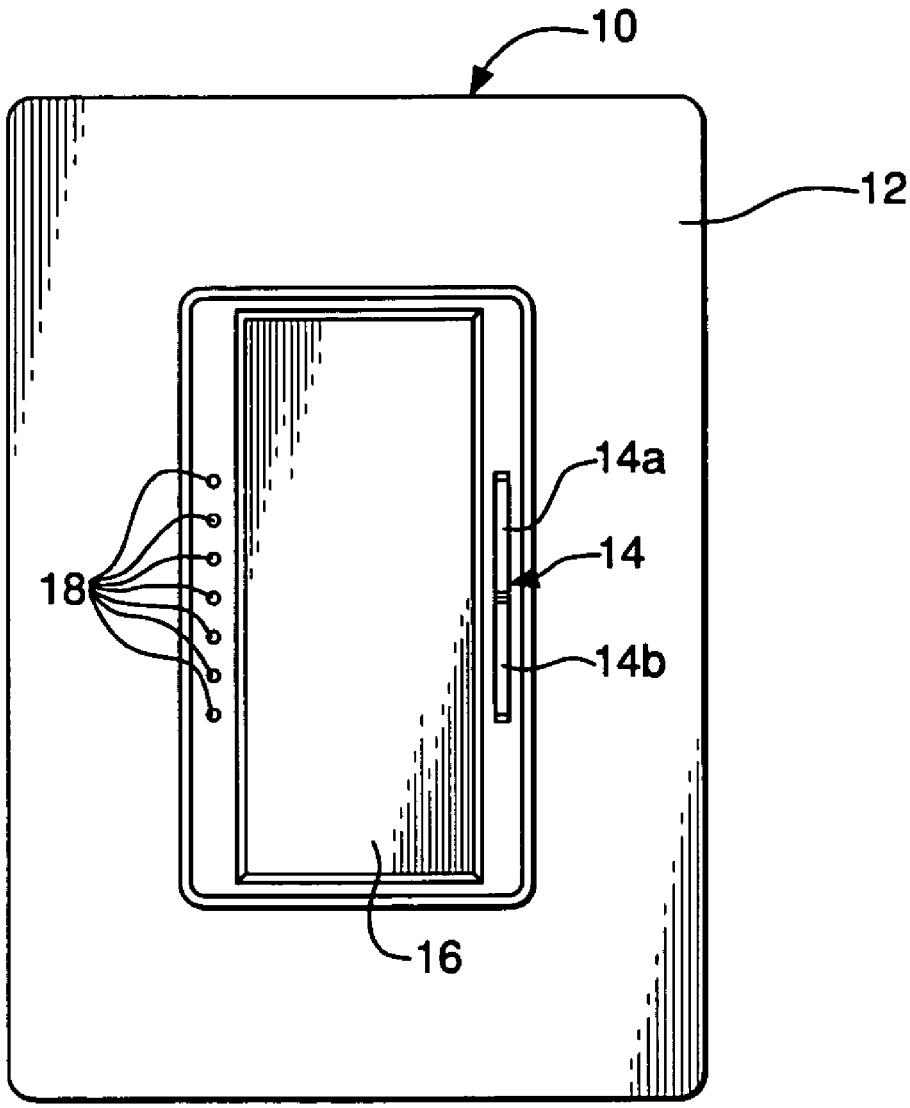
FIG. 1 Prior Art
FIG. 1 depicts a prior art wall control.
Figure 2A:
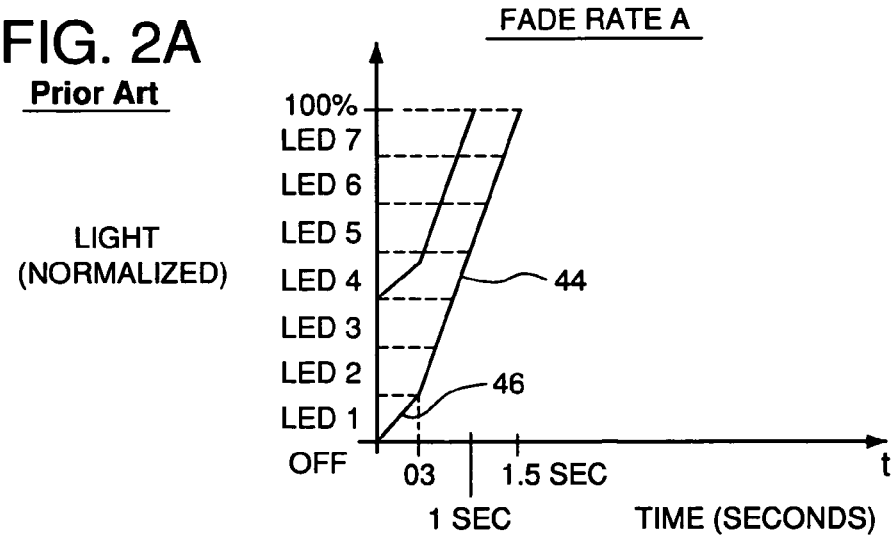
FIG. 2A Prior Art
FIGS. 2A–2D depict example fade rates and fade rate profiles in a prior art lighting control system.
Figure 2B:
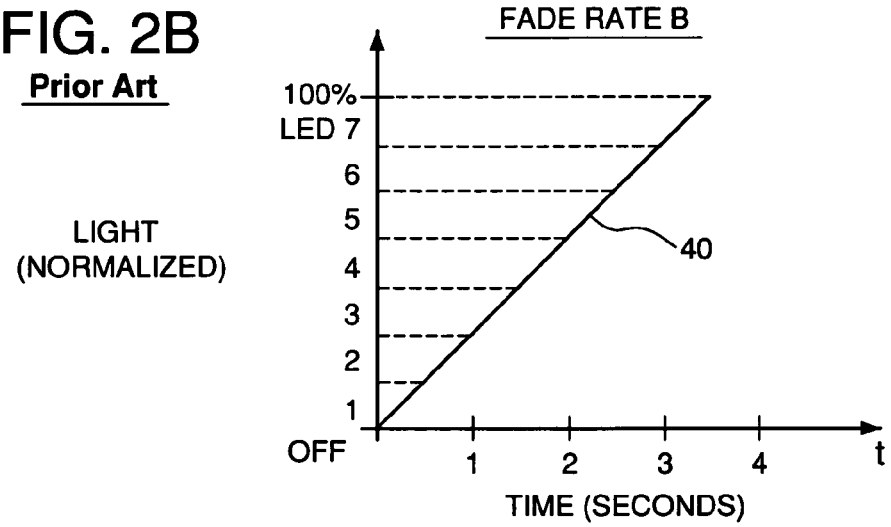
FIG. 2B Prior Art
Figure 2C:
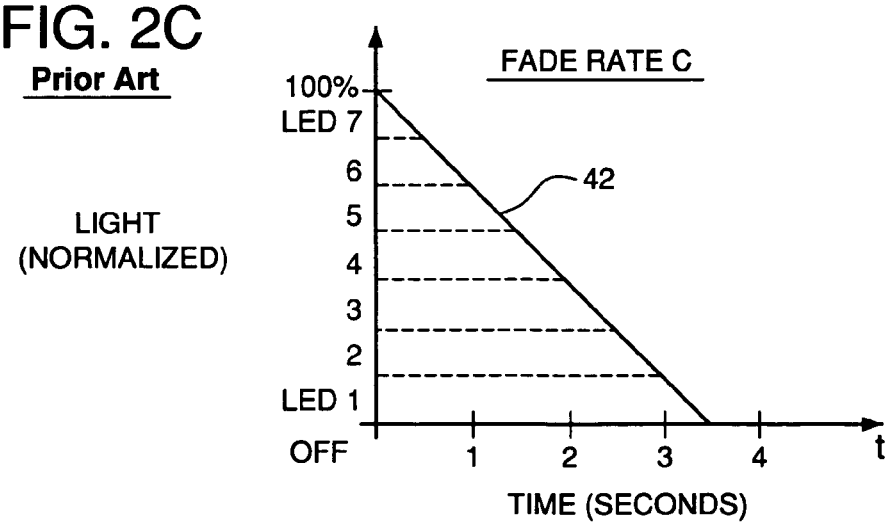
FIG. 2C Prior Art
Figure 2D:
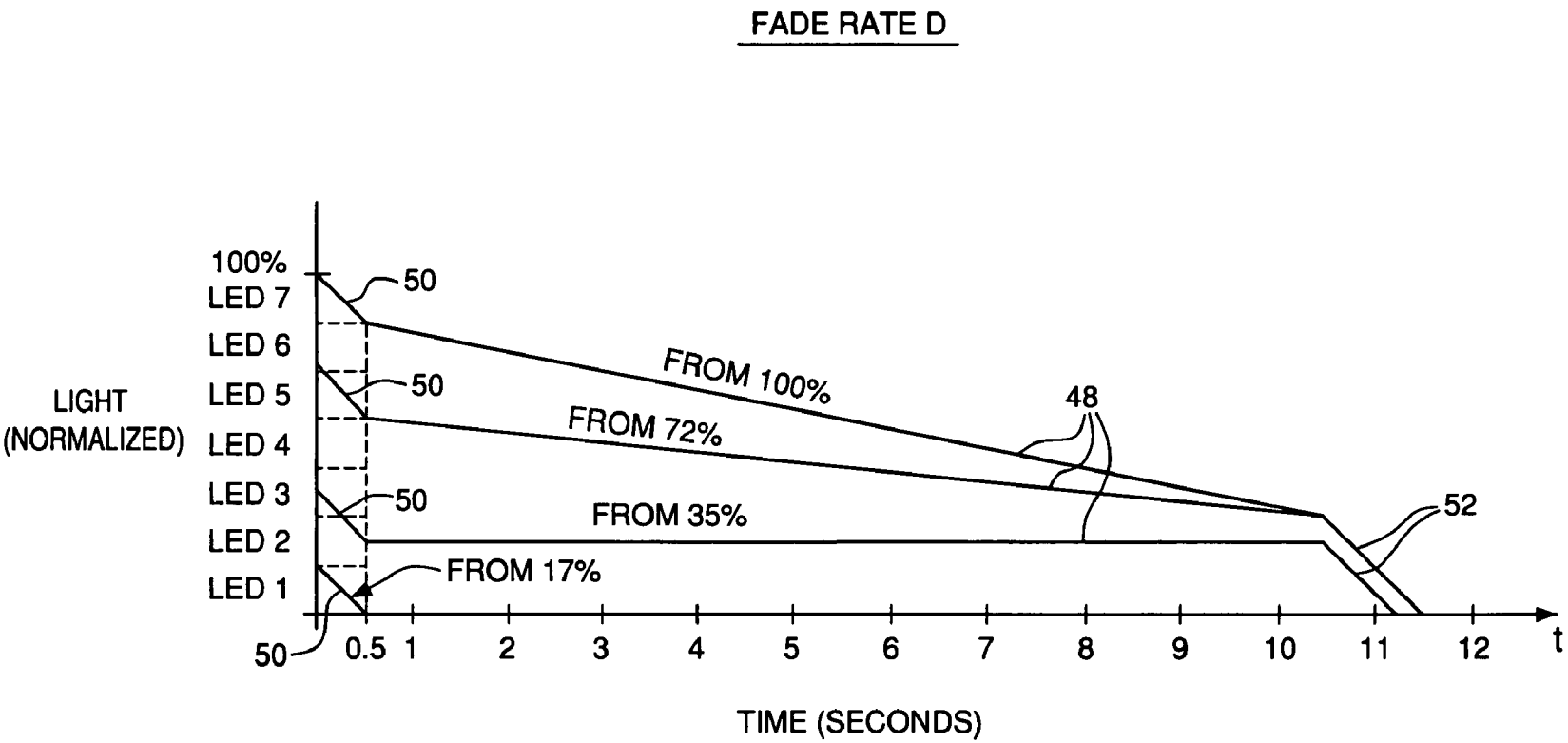
FIG. 2D Prior Art
Figure 3:
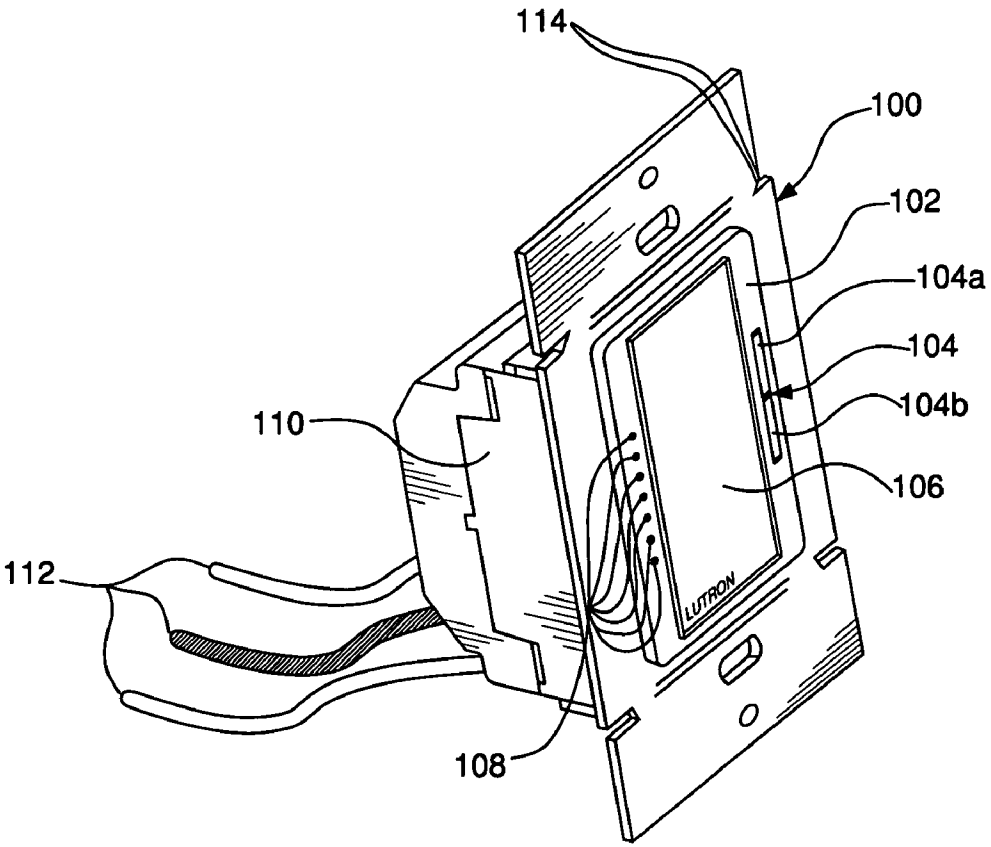
FIG. 3 depicts a wall control 100 embodying a lighting control device according to the invention.

FIG. 3 depicts a wall control 100 embodying a lighting control device according to the invention. Wall control 100 comprises a bezel 102, intensity selection actuator 104 for selecting a desired level of light intensity of a lamp controlled by the device, and a control switch actuator 106. Bezel 102 need not be limited to any specific form, and is preferably of a type adapted to be mounted to a conventional wall box commonly used in the installation of lighting control devices. Actuators 104 and 106 likewise are not limited to any specific form, and may be of any suitable design which permits manual actuation by a user.

Actuator 104 may control a rocker switch, for example, but may also control two separate push switches, for example, without departing from the invention. The switches controlled by actuator 104 may be directly wired into the control circuitry to be described below, or may be linked by an extended wired link, infrared link, radio frequency link, power line carrier link, or otherwise to the control circuitry. Likewise, the switch controlled by actuator 106 may also be directly wired into the control circuitry, or linked by an extended wired link, infrared link, radio frequency link, power line carrier link, or otherwise to the control circuitry. Actuators 104 and 106 may be linked to the corresponding switches in any convenient manner.

Actuator 106 may control a pushbutton type of switch, such as a toggle button, for example, but it may be of the touch-sensitive type or any other suitable type. Actuation of the upper portion 104*a* of actuator 104 increases or raises the light intensity level, while actuation of lower portion 104*b* of actuator 104 decreases or lowers the light intensity level.

Wall control 100 may include an intensity level indicator in the form of a plurality of light sources 108. Light sources 108 may be, but need not be, light-emitting diodes (LEDS) or the like. Light sources 108 may occasionally be referred to herein as LEDS, but it should be understood that such a reference is for ease of describing the invention and is not intended to limit the invention to any particular type of light source. Light sources 108 may be arranged in an array representative of a range of light intensity levels of the lamp or lamps being controlled from a minimum intensity level, preferably the lowest visible intensity (but which may be zero, or "full off") to a maximum intensity level (which is typically 100%, or "full on").

By illuminating a selected one of light sources 108 depending upon light intensity level, the position of the illuminated light source within the array will provide a visual indication of the light intensity relative to the range when the lamp or lamps being controlled are on. For example, seven LEDs are illustrated in FIG. 3 in a linear array. Illuminating the uppermost LED in the array will give an indication that the light intensity level is at or near maximum. Illuminating the center LED will give an indication that the light intensity level is at about the midpoint of the range. Any convenient number of light sources 108 may be used, and it will be understood that a larger number of light sources in the array will yield a commensurately finer gradation between intensity levels within the range.

When the lamp or lamps being controlled are off, all of the light sources 108 may be constantly illuminated at a low level of illumination, while the LED representative of the present intensity level in the on state is illuminated at a higher illumination level. This enables the light source array to be more readily perceived by the eye in a darkened environment, which assists a user in locating the switch in a dark room, for example, in order to actuate the switch to control the lights in the room, but still provides sufficient contrast between the level-indicating LED and the remaining LEDs to enable a user to perceive the relative intensity level at a glance.

Wall control 100 may include a standard back box 110, a plurality of high voltage wires 112 that may be hot, neutral, and dimmed hot, as described below, and a plurality of low voltage wires 114 that may be used to provide low voltage communications to the wall control 100.

Figure 4:
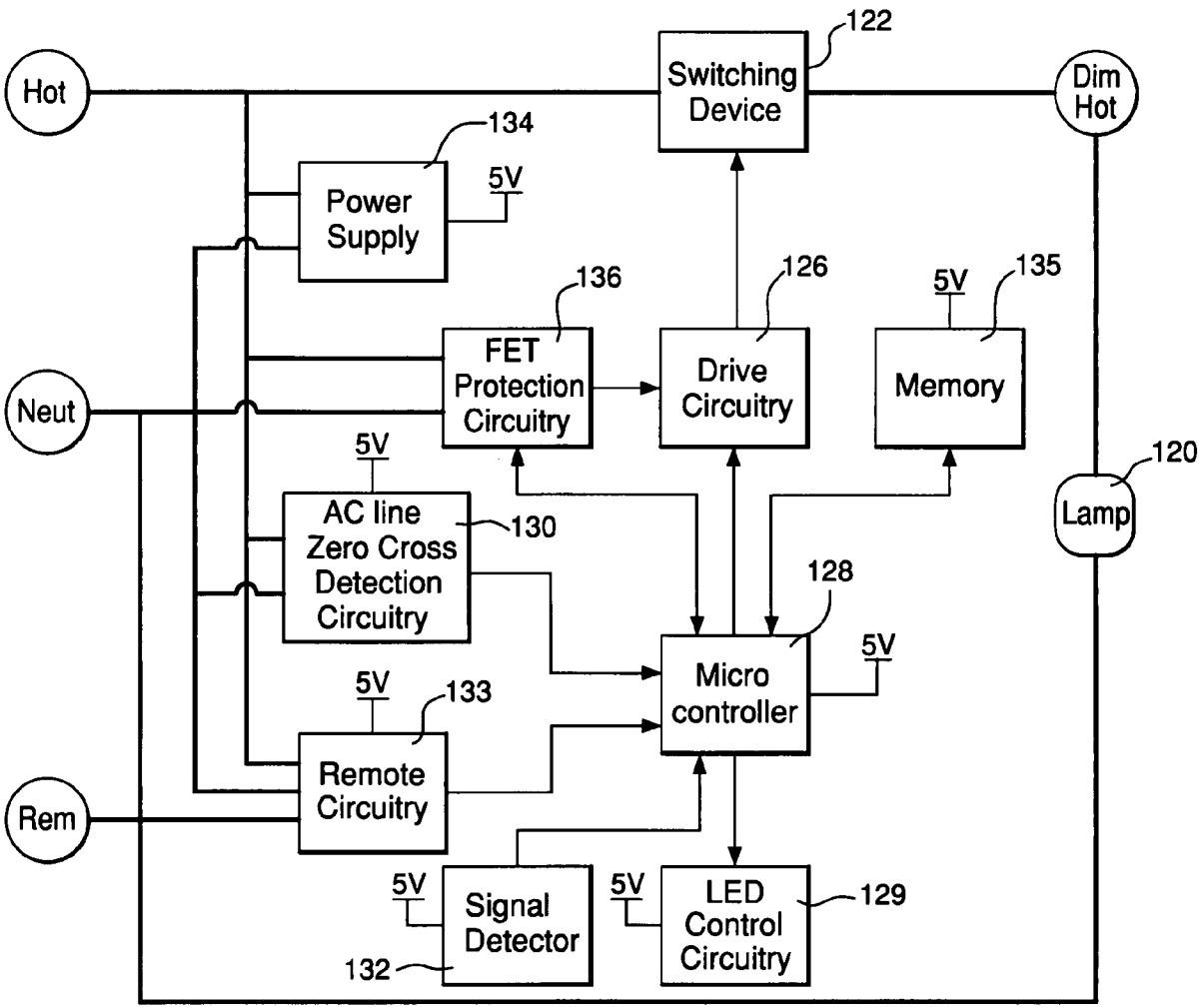
FIG. 4 is a simplified block diagram of example circuitry for a lighting control device according to the invention.

FIG. 4 is a simplified block diagram of example circuitry for a lighting control device according to the invention. The circuitry schematically illustrated in FIG. 4, or any portion thereof, may be contained in a standard back box, such as back box 110.

A lamp set 120, which may include one or more lamps, is connected between the hot and neutral terminals of a standard source of 120 V, 60 Hz AC power. Lamp set 120 may include one or more incandescent lamps, each of which may be rated between 40 W and several hundred watts, for example. It should be understood that the lamp set could include other loads such as electronic low voltage (ELV) or magnetic low voltage (MLV), for example, in addition to or instead of incandescent lighting.

The lamp set 120 may be connected through a solid state switching device 122, which may include one or more triacs, which may be thyristors or similar control devices. Conventional light dimming circuits typically use triacs to control the conduction of line current through a load, allowing a predetermined conduction time, and control the average electrical power to the light. One technique for controlling the average electrical power is forward phase control. In forward phase control, a switching device, which may include a triac, for example, is turned on at some point within each AC line voltage half cycle and remains on until the next current zero crossing. Forward phase control is often used to control power to a resistive or inductive load, which may be for example, a magnetic lighting transformer.

Because a triac device can only be selectively turned on, a field effect transistor (FET), such as a MOSFET (metal oxide semiconductor FET), for example, may be used for each half cycle of AC line input when turn-off phase is to be selectable. In reverse phase control, the switch is turned on at a voltage zero crossing of the AC line voltage and turned off at some point within each half cycle of the AC line current. Reverse phase control is often used to control power to a capacitive load, which may be for example, an electronic transformer connected low voltage lamp.

Switching device 122 has a control, or gate, input 124, which is connected to a gate drive circuit 126. As those skilled in the art will understand, control inputs on the gate input 124 will render the switching device 122 conductive or non-conductive, which in turn controls the power supplied to lamp set 120. Drive circuitry 126 provides control inputs to the switching device 122 in response to command signals from a microcontroller 128. FET protection circuitry 136 may also be provided. Such circuitry is well known and need not be described herein.

Microcontroller 128 may be any programmable logic device (PLD), such as a microprocessor or an application specific integrated circuit (ASIC), for example. Microcontroller 128 generates command signals to LED control circuitry 129, which controls the array of light sources 108. Inputs to microcontroller 128 are received from AC line zero-crossing detector 130 and signal detector 132. Power to microcontroller 128 is supplied by power supply 134. A memory 135, such as an EEPROM, for example, may also be provided.

Zero-crossing detector 130 determines the zero-crossing points of the input 60 Hz AC waveform from the AC power source. The zero-crossing information is provided as an input to microcontroller 128. Microcontroller 128 sets up gate control signals to operate switching device 122 to provide voltage from the AC power source to lamp set 120 at predetermined times relative to the zero-crossing points of the AC waveform. Zero-crossing detector 130 may be a conventional zero-crossing detector, and need not be described here in further detail. In addition, the timing of transition firing pulses relative to the zero crossings of the AC waveform is also known, and need not be described further.

Signal detector 132 receives as inputs switch closure signals from the toggle switch controlled by switch actuator 106, and the raise and lower switches controlled by the upper portion 104*a* and lower portion 104*b*, respectively, of intensity selection actuator 104.

Signal detector 132 detects when the switches are closed, and outputs signals representative of the state of the switches as inputs to microcontroller 128. Signal detector 132 may be any form of conventional circuit for detecting a switch closure and converting it to a form suitable as an input to a microcontroller. Those skilled in the art will understand how to construct signal detector 132 without the need for further explanation herein. Microcontroller 128 determines the duration of closure in response to inputs from signal detector 132.

Closure of a raise switch, such as by a user's depressing actuator 104*a*, initiates a preprogrammed "raise light level" routine in microcontroller 128 and causes microcontroller 128 to decrease the off (i.e., non-conduction) time of switching device 122 via gate drive circuit 126. Decreasing the off time increases the amount of time switching device 122 is conductive, which means that a greater proportion of AC voltage from the AC input is transferred to lamp 120. Thus, the light intensity level of lamp 120 may be increased. The off time decreases as long as the raise switch remains closed. As soon as the raise switch opens, e.g., by the user's releasing actuator 104*a*, the routine in the microcontroller is terminated, and the off time is held constant.

In a similar manner, closure of a lower switch, such as by a user's depressing actuator 104*b*, initiates a preprogrammed "lower light level" routine in microcontroller 128 and causes microcontroller 128 to increase the off time of switching device 122 via gate drive circuit 126. Increasing the off time decreases the amount of time switching device 122 is conductive, which means that a lesser proportion of AC voltage from the AC input is transferred to lamp 120. Thus, the light intensity level of lamp 120 may be decreased. The off time is increased as long as the lower switch remains closed. As soon as the lower switch opens, e.g., by the user's releasing actuator 104*b*, the routine in the microcontroller 128 is terminated, and the off time is held constant.

The actuation switch is closed in response to actuation of actuator 106, and will remain closed for as long as actuator 106 is depressed. Signal detector 132 provides a signal to microcontroller 128 indicating that the actuation switch has been closed. Microcontroller 128 determines the length of time that the actuation switch has been closed. Microcontroller 128 can discriminate between a closure of the actuation switch that is of only transitory duration (i.e., less than the actuator hold time described below) and a closure of the actuation switch that is of more than a transitory duration (i.e., greater than or equal to the actuator hold time described below). Thus, microcontroller 128 is able to distinguish between a "tap" of the actuator 106 (i.e., a closure of transitory duration) and a "hold" of the actuator 106 (i.e., a closure of more than transitory duration).

Microcontroller 128 is also able to determine when the actuation switch is transitorily closed a plurality of times in succession. That is, microcontroller 128 is able to determine the occurrence of two or more taps in quick succession.

Different closures of the actuation switch will result in different effects depending on the state of lamp 20 when the actuation switch is actuated. When lamp 120 is at an initial, non-zero intensity level, a single tap of actuator 106, i.e., a transitory closure of the actuation switch, will cause a fade to off. Operation of the controller under these conditions is described in detail below. Two taps in quick succession will initiate a routine in microcontroller 128 that causes the lamp 120 to fade from the initial intensity level to a preset desired intensity level at a preprogrammed fade rate. Operation of the controller under these conditions is described in detail in the 919 patent. A "hold" of the actuator 106, i.e., a closure of the actuation switch for more than a transitory duration, initiates a routine in microcontroller 128 that gradually fades in a predetermined fade rate sequence over an extended period of time from the initial intensity level to off. Operation of the controller under these conditions is described in detail below.

When the lamp 120 is off and microcontroller 128 detects a single tap or a closure of more than transitory duration, a preprogrammed routine is initiated in microcontroller 128 that causes the light intensity level of lamp 120 to fade from off to a preset desired intensity level at a preprogrammed fade rate. Two taps in quick succession will initiate a routine in microcontroller 128 that causes the light intensity level of the lamp 120 to fade at a predetermined rate from off to full. The fade rates may be the same, or they may be different. Operation of the controller under each of these conditions is described in detail in the 919 patent.

In addition, a further set of toggle, raise, and lower buttons may be provided in a remote location in a separate wall box, schematically illustrated in FIG. 4 by the dashed outline. The action of the remote toggle, raise, and lower buttons, and associated toggle, raise, and lower switches, corresponds to the action of actuation button 106, raise button 104*a*, lower button 104*b*, and their corresponding switches. Remote circuitry 133 may be provided to interface the remote wall control to the microcontroller 128.

Example scenarios of dimming using a lighting control device according to the invention will now be described in connection with FIGS. 5A–5D. FIGS. 5A–5D depict scenarios comparing fading profiles of a lighting control device according to the invention (shown in solid line) with those of a typical prior art lighting control device (shown in dashed line). Certain terms used in the following description are defined herein as follows.

"Hold time" or "button hold time" or "actuator hold time" is the amount of time the actuator (e.g., toggle button) must be actuated (e.g., pressed) to cause the generation of a "hold" action (i.e., for the microcontroller to identify a "hold" as described above). In an example embodiment of the invention, the default value for the actuator hold time may be about 0.5 seconds. It is anticipated that the actuator hold time will be between about 0.01 and about 2.56 seconds for most applications, though it should be understood that the actuator hold time may be chosen to be any value suitable for the particular application.

"Fade off time" is a predefined amount of time allotted for the controller to cause the lighting to fade from its current light intensity level to off. The fade off time is used to compute the fade rate employed from the time the actuator is initially actuated until the hold time elapses. According to the invention, the fade off time is defined to be greater than the hold time so that the controller does not cause the lighting to fade to off before the hold time elapses. In an example embodiment of the invention, the default value for the fade off time may be about 2.25 seconds. It is anticipated that the fade off time will be between about 0 and about 64 seconds for most applications, though it should be understood that the fade off time may be chosen to be any value suitable for the particular application.

"Long fade time" is the amount of time, after the hold time elapses, for which the controller causes the lighting to fade according to a second, preferably slower, e.g., exponential, fade profile. In an example embodiment of the invention, the default value for the long fade time is 10 seconds. It is anticipated that the long fade time will be between about 0 seconds and about 4 hours for most applications, though it should be understood that the long fade time may be chosen to be any value suitable for the particular application.

"Fade off rate" is a predefined rate at which the controller causes the lighting to fade to off. The fade off rate is employed following the expiration of the long fade time. In an example embodiment of the invention, the default value for the fade off rate may be the rate that would be necessary to cause the lighting to fade from 100% intensity to off in about 2.75 seconds. It is anticipated that time allotted for fading from full on to full off might be between about 0 and about 64 seconds for most applications, though it should be understood that the fade off rate may be chosen to be any value suitable for the particular application.

"LED flash rate" is the rate at which the intensity level indicator 108 flashes during the long fade time. In an example embodiment of the invention, the default value for the LED flash rate may be 2 Hz. It is anticipated that this rate might between about 0.2 and about 50 Hz for most applications, though it should be understood that the flash rate may be chosen to be any value suitable for the particular application.

An example dimming scenario using a lighting control device according to the invention may be described generally as follows. A user presses the toggle button 106 while the light intensity level of the at least one lamp is non-zero. The microcontroller detects the resultant switch closure, and causes the light intensity level to fade at a first fade rate that is based on the fade off time, i.e., the predefined amount of time allotted for the controller to cause the lighting to fade from its current light intensity level to off.

If the user continues to press the toggle button 106 until the button hold time elapses, the microcontroller interrupts fading at the first fade rate, and causes the light intensity level to fade at a second, e.g., exponential, fade rate. At this point, the long fade time begins, and the intensity level indicator 108 begins flashing.

After the long fade time expires, the microcontroller interrupts fading at the second fade rate, and begins causing the light intensity level to fade at a third fade rate, i.e., the fade off rate, which is the predefined rate at which the controller is programmed to cause the light intensity level to fade to zero. The intensity level indicator stops flashing.

Figure 5A:
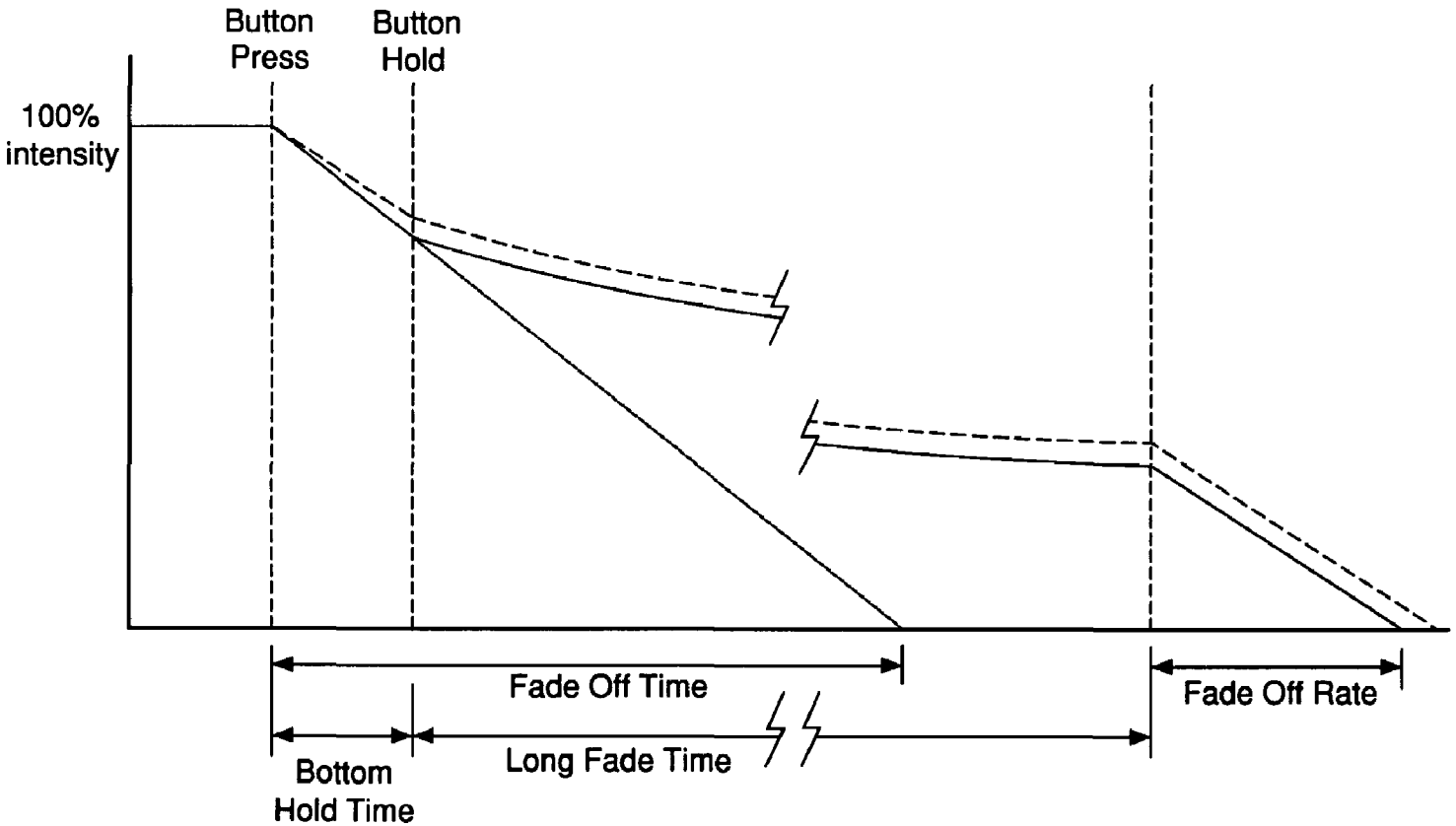
FIGS. 5A–5D depict scenarios comparing fading profiles of a lighting control device according to the invention with those of a typical prior art lighting control device.

FIG. 5A depicts a scenario in which the light intensity level is initially relatively high (e.g., 100%), and a user presses and holds the toggle button for at least the button hold time. From the time the toggle button is first pressed, until the button hold time elapses, the controller causes the light intensity level to fade at a first fade rate that is based on the fade off time (and, thus, on the initial light intensity level of the at least one lamp). Specifically, the first fade rate may be the rate that would be necessary to fade the lighting from the initial intensity level to off over the course of the fade off time.

The steep slope of fade off time allows the user to visually see a light intensity change. More dramatic changes in light intensity may be desirable at high intensities so the user's eye can perceive a change. The user immediately sees the result of the toggle button press.

After the button hold time elapses, the controller interrupts fading at the first fade rate, and then causes the light intensity level to fade at a second fade rate for the duration of the long fade time. In an example embodiment of the invention, the second fade rate may be an exponential fade rate that is slower than the first fade rate. Thus, the user is able to detect the start of the long fade time because the change to exponential fade immediately results in less dramatic changes in light intensity level than does fading based on the first fade rate.

After the long fade time elapses, the controller interrupts fading at the second fade rate, and causes the light intensity level to fade to off at a third fade rate, e.g., the fade off rate.

By contrast, the prior art system causes the light intensity level to fade at the fade off rate from the time the toggle button is first pressed until the button hold time expires. Because the first fade rate in this scenario, which is based on the fade off time, is greater than the fade rate employed by the prior art system, the long fade time starts with the lighting at a lower light intensity level in the system of the invention than it does in the prior art system.

Figure 5B:
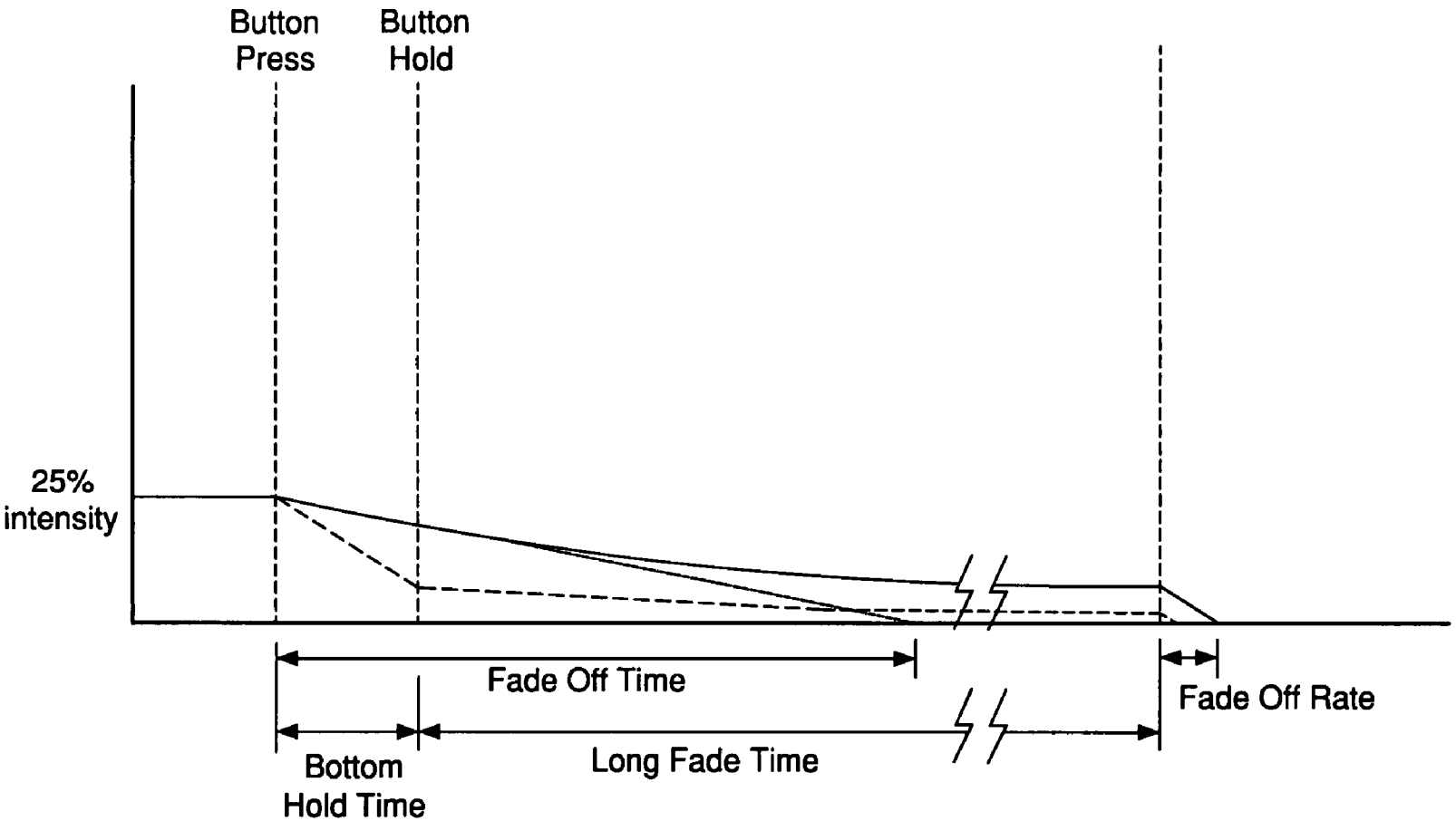

FIG. 5B depicts a scenario in which the light intensity level is initially relatively low (e.g., 25%), and a user presses and holds the toggle button for at least the button hold time. From the time the toggle button is first pressed, until the button hold time elapses, the controller causes the light intensity level to fade at a first fade rate that is based on the fade off time. Specifically, the first fade rate may be the rate at which the lighting may be faded from the initial intensity to off over the course of the fade off time. The shallow slope of fade off time prevents light intensity from significantly decreasing or even turning off prior to long fade time activation.

After the button hold time elapses, the controller interrupts fading at the first fade rate, and then causes the light intensity level to fade at a second fade rate for the duration of the long fade time. In an example embodiment of the invention, the second fade rate may be an exponential fade rate that is slower than the first fade rate. It should be understood that any fade profile may be chosen for the second fade rate without departing from the scope of the invention.

After the long fade time elapses, the controller interrupts fading at the second fade rate, and causes the light intensity level to fade to off at a third fade rate, e.g., the fade off rate. It should be understood that any fade rate may be chosen for the third fade rate without departing from the scope of the invention.

By contrast, the prior art system causes the light intensity level to fade at the fade off rate from the time the toggle button is first pressed until the button hold time expires. Because the first fade rate in this scenario, which is based on the fade off time, is slower than the fade rate employed by the prior art system, the long fade time starts with the lighting at a higher light intensity level in the system of the invention than it does in the prior art system.

Figure 5C:
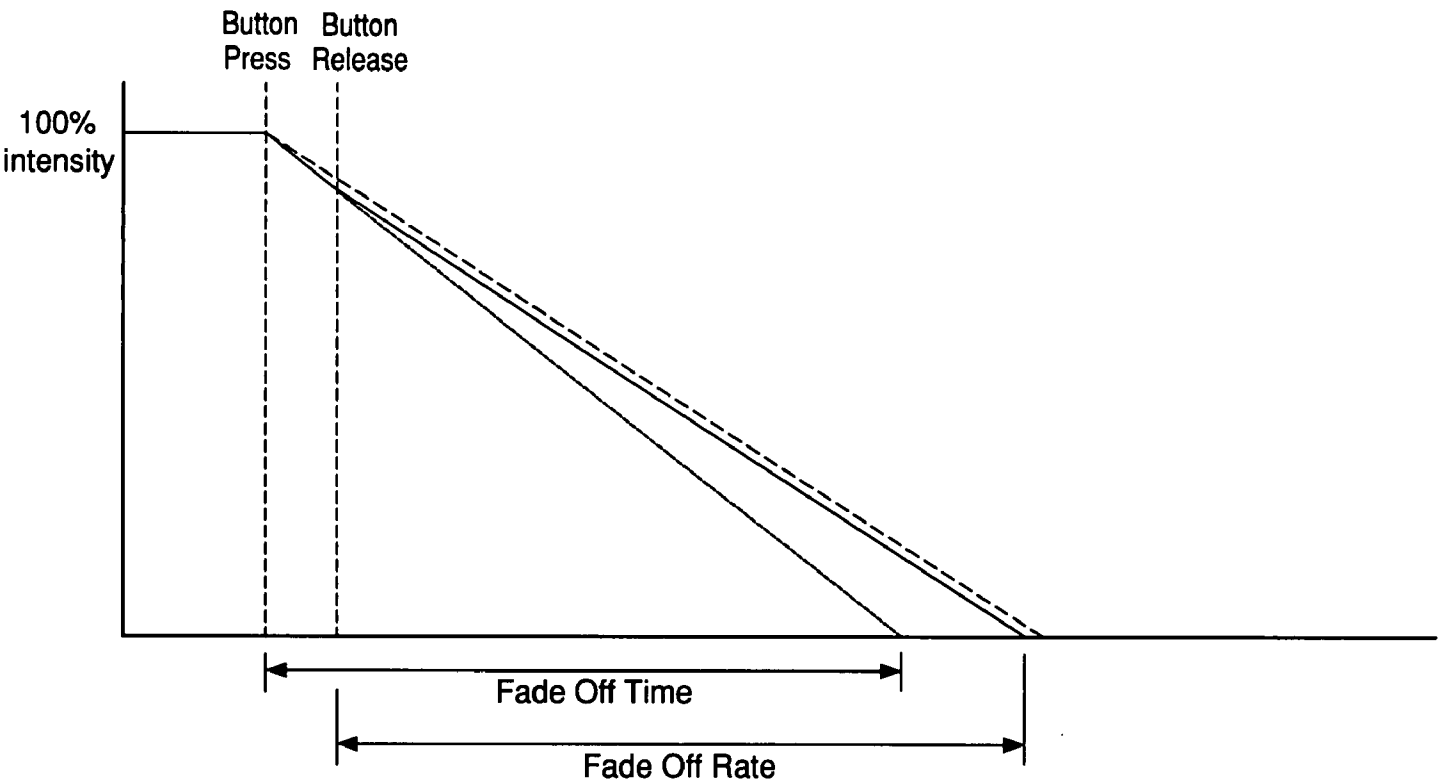

FIG. 5C depicts a scenario in which the light intensity level is initially relatively high (e.g., 100%), and a user presses and releases the toggle button before the button hold time elapses. From the time the toggle button is first pressed, until the time the toggle button is released, the controller causes the light intensity level to fade at a first fade rate that is based on the fade off time. Specifically, the first fade rate may be the rate at which the lighting may be faded from the initial intensity level to off over the course of the fade off time. After the button is released, the controller interrupts fading at the first fade rate, and causes the light intensity level to fade at a second fade rate, i.e., the fade off rate.

By contrast, the prior art system causes the light intensity level to fade at the fade off rate from the time the toggle button is first pressed.

Figure 5D:
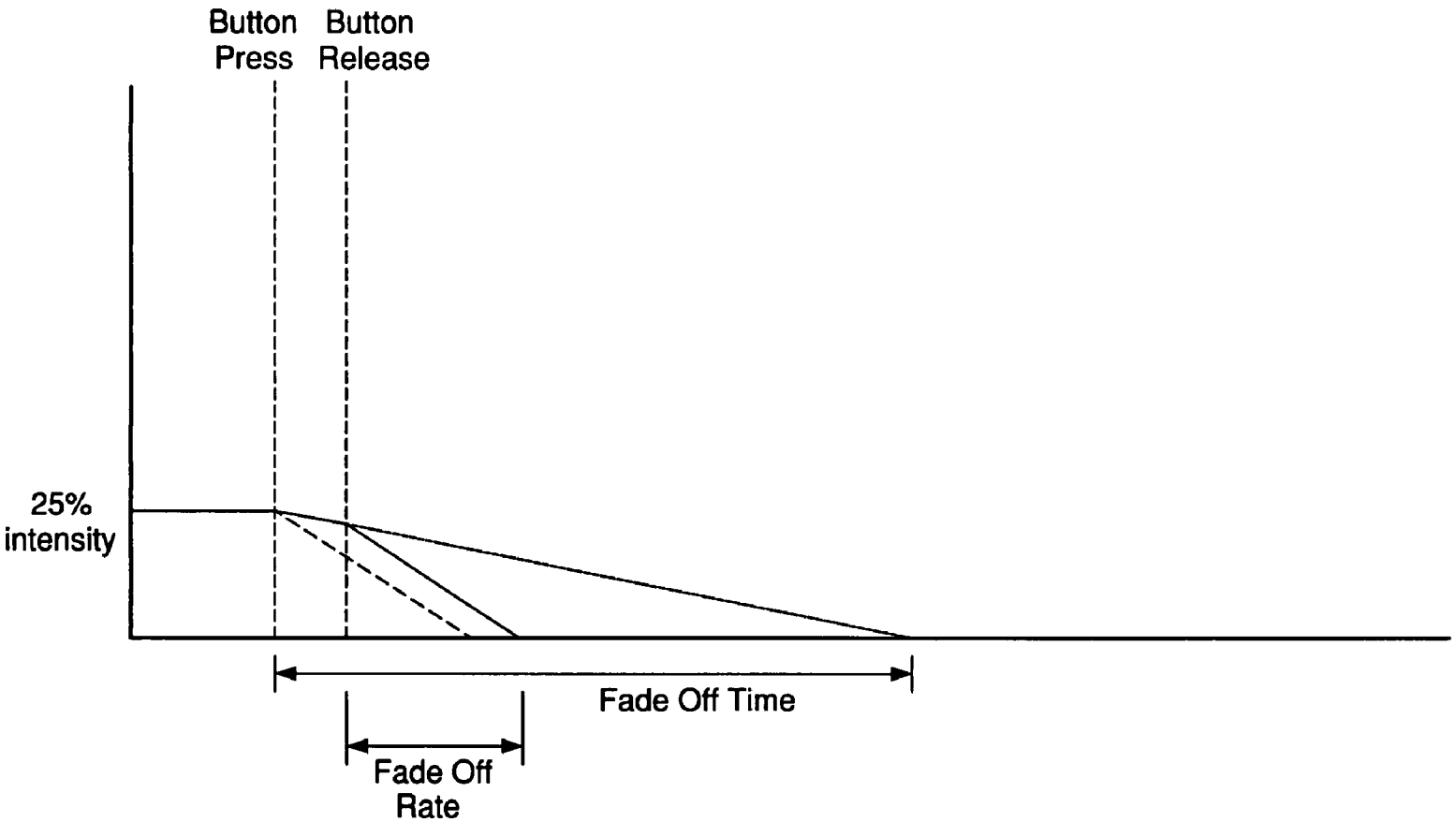

FIG. 5D depicts a scenario in which the light intensity level is initially relatively low (e.g., 25%), and a user presses and releases the toggle button before the button hold time elapses. From the time the toggle button is first pressed, until the time the button is released, the controller causes the light intensity level to fade at a first fade rate that is based on the fade off time. Specifically, the first fade rate may be the rate at which the lighting may be faded from the initial intensity to off over the course of the fade off time. After the toggle button is released, the controller interrupts fading at the first fade rate, and causes the light intensity level to fade at a second fade rate, i.e., the fade off rate.

By contrast, the prior art system causes the light intensity level to fade at the fade off rate from the time the toggle button is first pressed. It should be understood that, in such a prior art system, if the initial intensity level were low enough, the lighting would fade to off before the button hold time elapsed. In a system according to the invention, the fade off time (and, therefore, the first fade rate) may be chosen so that the light intensity level does not fade to off at least until the button hold time elapses.

Figure 6:
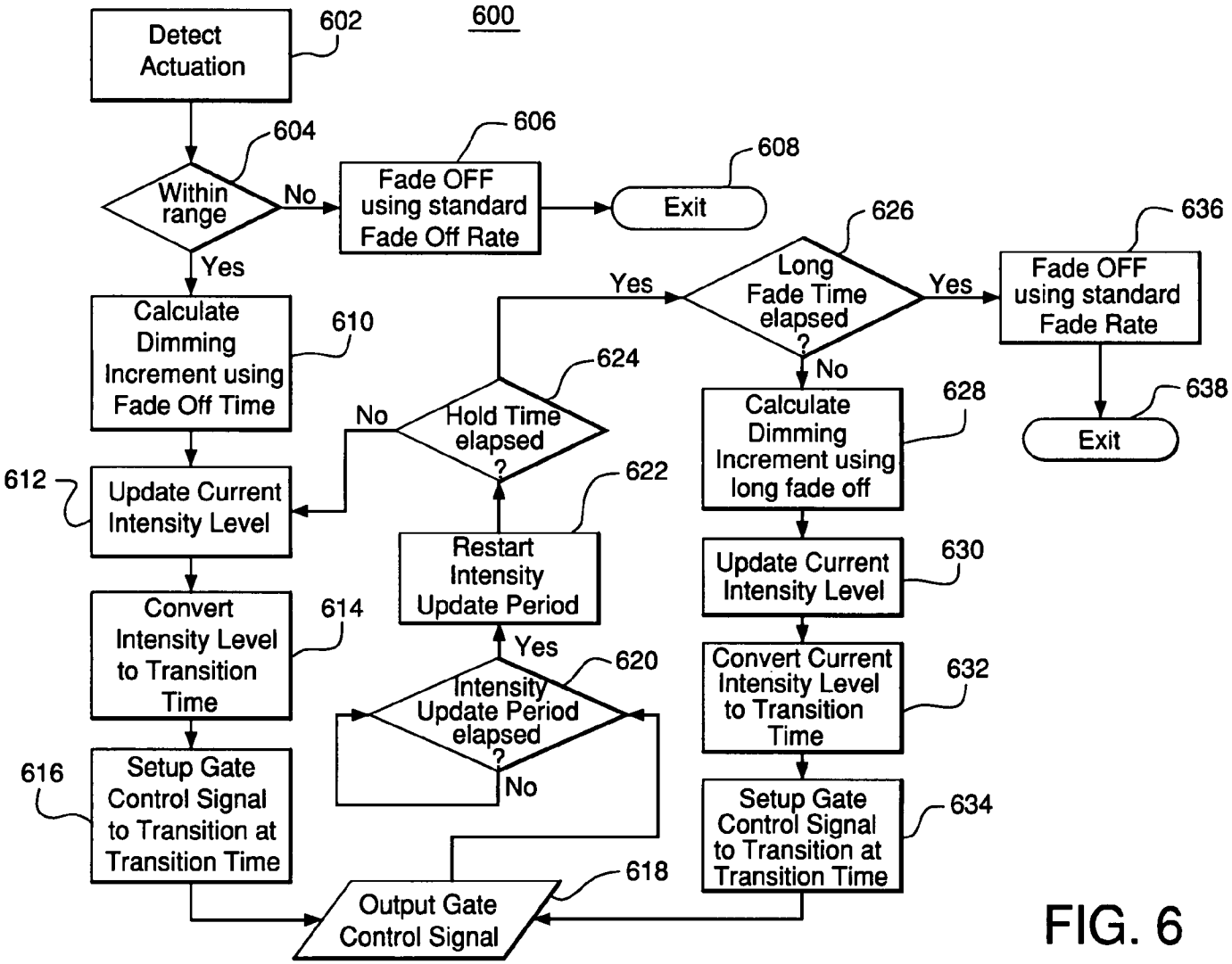
FIG. 6 is a flow diagram illustrating the operation of a control device according to the invention.

FIG. 6 is a flow diagram illustrating the operation 600 of a control device according to the invention. Such operation may be performed by a software program executing on the microcontroller, for example. Such a program may also exist as a set of computer executable instructions stored on any computer readable medium, such as a computer hard drive, removable magnetic medium, tape, compact disc, floppy disc, or the like. The operation 600 begins at step 602 with a determination that the toggle button has been pressed while the light intensity level is non-zero (i.e., while the lights are on).

At step 604, it is determined whether the fade off time is "within range," i.e., whether the fade off time is greater than the button hold time and less than (or equal to) a predefined maximum fade off time. If it is determined that the fade off time is not within range, then, at step 606, the controller causes the lighting to fade to off at the fade off rate, and the program exits at step 608.

If, at step 604, it is determined that the fade off time is within range, then, at step 610, the initial dimming increment, $\Delta D_i$, is calculated based on the fade off time. The predefined fade off time, $T_F$, divided by a preprogrammed intensity update period, $T_U$, gives the number of intensity updates that will occur during a fade to off from the initial intensity level, $D_i$. The dimming increment, $\Delta D_i$, therefore, may be computed as $\Delta D_i=(T_U*D_i)/T_F$. An example intensity update period, $T_U$, may be about 10 ms.

At step 612, the current intensity level D is updated by the dimming increment $\Delta D_i$. That is, $D \rightarrow D-\Delta D_i$. At step 614, the current intensity level D is converted to a corresponding switching device transition time t. At step 616, a gate control signal is set up to transition at the transition time t. At step 618, the microcontroller sends the gate control signal to the gate drive circuitry, which, in turn, enables or disables switching device conduction.

At step 620, the program loops until it is determined that the intensity update period $T_U$ has elapsed. At step 622, the intensity update period timer is restarted. At step 624, it is determined whether the button hold time has elapsed. If it has not, then the program returns to step 612 to cause the current intensity level to be updated again, still using the first fade rate.

If, at step 624, it is determined that the button hold time has elapsed, then, at step 626, it is determined whether the long fade time has elapsed. If it has not, then, at step 628, the dimming increment for long fade off, $\Delta D_1$, is calculated according to $\Delta D_1=(D=1)/N$, where N is a predetermined scalar set to create a slow fade rate (e.g., N=1024). The value "1" may be subtracted to guarantee the lighting remains on even if the current intensity level D is 1%.

At step 630, the current intensity level D is updated by the dimming increment $\Delta D_1$. That is, $D \rightarrow D-\Delta D_1$. At step 632, the current intensity level D is converted to a corresponding switching device transition time t. At step 634, a gate control signal is set up to transition at the transition time t. At step 618, the microcontroller sends the gate control signal to the gate drive circuitry. The program loops, at step 620, until it is determined that the intensity update period $T_U$ has elapsed.

If, at step 626, it is determined that the long fade time has elapsed, then, at step 636, the lighting fades to off at the preprogrammed fade off rate. The program exits at step 638.

Thus there have been described improved lighting control devices that cause the light intensity level of at least one lamp to fade at fade rate based on its initial intensity when a switch controller is actuated. It should be understood that the invention may be embodied in other specific forms without departing from the spirit or essential attributes thereof and, accordingly, reference should be made to the appended claims, rather than to the foregoing specification, as indicating the scope of the invention.

What is claimed:

1. A lighting control device for controlling a light intensity level of at least one lamp, the at least one lamp having an initial light intensity level, the lighting control device comprising:

a microcontroller; and a user-actuatable switch controller operatively coupled to the microcontroller, wherein the microcontroller causes the light intensity level of the at least one lamp to fade at a first fade rate when the switch controller is actuated, the first fade rate being based on a predefined fade-off time, the fade-off time representing a time duration allotted for fading the light intensity level of the at least one lamp from the initial light intensity level to off; and wherein the microcontroller causes the light intensity level of the at least one lamp to fade at a second fade rate upon a determination that the switch controller has been actuated for at least a predefined actuator hold time.

2. The lighting control device of claim 1, wherein the fade-off time is defined to be longer than the actuator hold time.

3. The lighting control device of claim 1, wherein the microcontroller causes the light intensity level of the at least one lamp to fade at the second fade rate for a predefined long fade time.

4. The lighting control device of claim 3, wherein the microcontroller causes the light intensity level of the at least one lamp to fade to off at a third fade rate after the long fade time elapses.

5. The lighting control device of claim 1, wherein the second fade rate is slower than the first fade rate.

6. The lighting control device of claim 1, wherein the second fade rate has an exponential fade profile.

7. The lighting control device of claim 4, wherein the third fade rate is a predefined rate at which the microcontroller is programmed to cause the light intensity level to fade from 100% to off over a predefined amount of time.

8. The lighting control device of claim 1, wherein the microcontroller causes the light intensity level of the at least one lamp to fade to off at a third fade rate upon a determination that the switch controller has been actuated for only a transitory duration.

9. A lighting control device for controlling a light intensity level of at least one lamp, the at least one lamp having an initial light intensity level, the lighting control device comprising:

a microcontroller; and a user-actuatable switch controller operatively coupled to the microcontroller, wherein the microcontroller causes the light intensity level of the at least one lamp to fade at a first fade rate when the switch controller is actuated and at a second fade rate upon a determination that the switch controller has been actuated for at least a predefined actuator hold time, wherein the first fade rate is based on a predefined fade-off time that is longer than the predefined actuator hold time.

10. The lighting control device of claim 9, wherein the microcontroller causes the light intensity level of the at least one lamp to fade at the second fade rate for a predefined long fade time.

11. The lighting control device of claim 10, wherein the microcontroller causes the light intensity level of the at least one lamp to fade to off at a third fade rate after the long fade time elapses.

12. The lighting control device of claim 11, wherein the third fade rate is a predefined rate at which the microcontroller is programmed to cause the light intensity level to fade from 100% to off over a predefined amount of time.

13. The lighting control device of claim 9, wherein the microcontroller causes the light intensity level of the at least one lamp to fade to off at a third fade rate upon a determination that the switch controller has been actuated for only a transitory duration.

14. The lighting control device of claim 9, wherein the second fade rate is slower than the first fade rate.

15. The lighting control device of claim 9, wherein the second fade rate has an exponential fade profile.

16. A method for controlling a light intensity level of at least one lamp, the at least one lamp having an initial light intensity level, the method comprising:

determining that a switch actuator has been actuated; and causing the light intensity level of the at least one lamp to fade at a first fade rate that is based on the initial intensity level of the at least one lamp, wherein the first fade rate is based on a predefined fade-off time, the fade-off time representing a time duration allotted for fading the light intensity level of the at least one lamp from the initial light intensity level to off.

17. The method of claim 16, further comprising:

causing the light intensity level of the at least one lamp to fade at a second fade rate upon a determination that the switch controller has been actuated for at least a predefined actuator hold time.

18. The method of claim 17, wherein the second fade rate has an exponential fade profile.

19. The method of claim 17, wherein the second fade rate is slower than the first fade rate.

20. The method of claim 17, further comprising:

causing the light intensity level of the at least one lamp to fade to off at a third fade rate upon a determination that the switch controller has been actuated for only a transitory duration.

21. The method of claim 20, wherein the third fade rate is faster than the second fade rate.

22. The method of claim 17, wherein the first fade rate is based on a predefined fade-off time that is longer than the predefined actuator hold time.

23. The method of claim 17, further comprising:

causing the light intensity level of the at least one lamp to fade at the second fade rate for a predefined long fade time.

24. The method of claim 23, further comprising:

causing the light intensity level of the at least one lamp to fade to off at a third fade rate after the long fade time elapses.

25. The method of claim 24, wherein the third fade rate is a predefined rate for causing the light intensity level to fade from 100% to off over a predefined amount of time.

26. A method for controlling a light intensity level of at least one lamp, the at least one lamp having an initial light intensity level, the method comprising:

determining that a switch actuator has been actuated;

causing the light intensity level of the at least one lamp to fade at a first fade rate that is based on the initial intensity level of the at least one lamp; and causing the light intensity level of the at least one lamp to fade at a second fade rate upon a determination that the switch controller has been actuated for at least a predefined actuator hold time.

27. The method of claim 26, wherein the second fade rate is slower than the first fade rate.

28. The method of claim 26, wherein the second fade rate has an exponential fade profile.

29. The method of claim 26, further comprising:

causing the light intensity level of the at least one lamp to fade at the second fade rate for a predefined long fade time.

30. The method of claim 29, further comprising:

causing the light intensity level of the at least one lamp to fade to off at a third fade rate after the long fade time elapses.

31. The method of claim 30, wherein the third fade rate is a predefined rate for causing the light intensity level to fade from 100% to off over a predefined amount of time.

32. The method of claim 26, further comprising:

causing the light intensity level of the at least one lamp to fade to off at a third fade rate upon a determination that the switch controller has been actuated for only a transitory duration.

33. The method of claim 32, wherein the third fade rate is faster than the second fade rate.

34. The method of claim 26, wherein the first fade rate is based on a predefined fade-off time, the fade-off time representing a time duration allotted for fading the light intensity level of the at least one lamp from the initial intensity level to off.

35. The method of claim 26, wherein the first fade rate is based on a predefined fade-off time that is longer than the predefined actuator hold time.

36. A computer-readable medium having stored thereon computer-executable instructions for performing a method for controlling a light intensity level of at least one lamp, the at least one lamp having an initial light intensity level, the method comprising:

determining that a switch actuator has been actuated; and causing the light intensity level of the at least one lamp to fade at a fade rate that is based on the initial intensity level of the at least one lamp, wherein the fade rate is based on a predefined fade-off time, the fade-off time representing a time duration allotted for fading the light intensity level of the at least one lamp from the initial light intensity level to off.

37. A lighting control device for controlling a light intensity level of at least one lamp, the at least one lamp having an initial light intensity level, the lighting control device comprising:

a microcontroller; and a user-actuatable switch controller operatively coupled to the microcontroller, wherein, upon a determination that the switch controller has been actuated, the microcontroller causes the light intensity level of the at least one lamp to fade at a first fade rate that is based on the initial light intensity level of the at least one lamp, and wherein, upon a determination that the switch controller has been actuated for only a single transitory duration, the microcontroller causes the light intensity level of the at least one lamp to fade to off at a second fade rate, and wherein, upon a determination that the switch controller has been actuated for two successive transitory durations, the microcontroller causes the light intensity level of the at least one lamp to fade from the initial intensity level to a preset desired intensity level at a third fade rate, and wherein, upon a determination that the switch controller has been actuated for more than a transitory duration, the microcontroller causes the light intensity level of the at least one lamp to fade to off in a predetermined fade rate sequence.

38. A lighting control device for controlling a light intensity level of at least one lamp, the at least one lamp having an initial light intensity level, the lighting control device comprising:

a microcontroller; and a user-actuatable switch controller operatively coupled to the microcontroller, wherein, upon a determination that the switch controller has been actuated, the microcontroller causes the light intensity level of the at least one lamp to fade at a fade rate that is based on the initial light intensity level of the at least one lamp, and wherein the fade rate is based on a predefined fade-off time, the fade-off time representing a time duration allotted for fading the light intensity level of the at least one lamp from the initial light intensity level to off.

39. The lighting control device of claim 38, wherein the second fade rate has an exponential fade profile.

40. The lighting control device of claim 38, wherein the fade-off time is defined to be longer than a predefined actuator hold time.

41. The lighting control device of claim 38, wherein the microcontroller causes the light intensity level of the at least one lamp to fade at a second fade rate for a predefined long fade time.

42. The lighting control device of claim 41, wherein the microcontroller causes the light intensity level of the at least one lamp to fade to off at a third fade rate after the long fade time elapses.

43. The lighting control device of claim 42, wherein the third fade rate is a predefined rate at which the microcontroller is programmed to cause the light intensity level to fade from 100% to off over a predefined amount of time.

44. The lighting control device of claim 38, wherein the microcontroller causes the light intensity level of the at least one lamp to fade to off at a third fade rate upon a determination that the switch controller has been actuated for only a transitory duration.

45. The lighting control device of claim 38, wherein the second fade rate is slower than the first fade rate.

46. A computer-readable medium having stored thereon computer-executable instructions for performing a method for controlling a light intensity level of at least one lamp, the at least one lamp having an initial light intensity level, the method comprising:

determining that a switch controller has been actuated;

causing, upon a determination that the switch controller has been actuated, the light intensity level of the at least one lamp to fade at a first fade rate that is based on the initial light intensity level of the at least one lamp;

causing, upon a determination that the switch controller has been actuated for only a single transitory duration, the light intensity level of the at least one lamp to fade to off at a second fade rate;

causing, upon a determination that the switch controller has been actuated for two successive transitory durations, the light intensity level of the at least one lamp to fade from the initial intensity level to a preset desired intensity level at a third fade rate; and causing, upon a determination that the switch controller has been actuated for more than a transitory duration, the light intensity level of the at least one lamp to fade to off in a predetermined fade rate sequence.

47. A lighting control device for controlling a light intensity level of at least one lamp, the at least one lamp having an initial light intensity level, the lighting control device comprising:

a microcontroller; and a user-actuatable switch controller operatively coupled to the microcontroller, wherein, upon a determination that the switch controller has been actuated, the microcontroller causes the light intensity level of the at least one lamp to fade at a first fade rate that is based on the initial light intensity level of the at least one lamp; and wherein the microcontroller causes the light intensity level of the at least one lamp to fade at a second fade rate upon a determination that the switch controller has been actuated for at least a predefined actuator hold time.

48. The lighting control device of claim 47, wherein the fade-off time is defined to be longer than the actuator hold time.

49. The lighting control device of claim 47, wherein the microcontroller causes the light intensity level of the at least one lamp to fade at the second fade rate for a predefined long fade time.

50. The lighting control device of claim 49, wherein the microcontroller causes the light intensity level of the at least one lamp to fade to off at a third fade rate after the long fade time elapses.

51. The lighting control device of claim 50, wherein the third fade rate is a predefined rate at which the microcontroller is programmed to cause the light intensity level to fade from 100% to off over a predefined amount of time.

52. The lighting control device of claim 50, wherein the microcontroller causes the light intensity level of the at least one lamp to fade to off at a third fade rate upon a determination that the switch controller has been actuated for only a transitory duration.

53. The lighting control device of claim 47, wherein the second fade rate is slower than the first fade rate.

54. The lighting control device of claim 47, wherein the second fade rate has an exponential fade profile.

55. A method for controlling a light intensity level of at least one lamp, the at least one lamp having an initial light intensity level, the method comprising:

determining that a switch controller has been actuated;

causing the light intensity level of the at least one lamp to fade at a first fade rate that is based on a predefined fade-off time, the fade-off time representing a time duration allotted for fading the light intensity level of the at least one map from the initial light intensity level to off;

causing the light intensity level of the at least one lamp to fade at a second fade rate upon a determination that the switch controller has been actuated for at least a predefined actuator hold time.

56. The method of claim 55, wherein the first fade rate is based on a predefined fade-off time, the fade-off time representing a time duration allotted for fading the light intensity level of the at least one lamp from the initial intensity level to off.

57. The method of claim 55, wherein the first fade rate is based on a predefined fade-off time that is longer than the predefined actuator hold time.

58. The method of claim 55, wherein the second fade rate is slower than the first fade rate.

59. The method of claim 55, wherein the second fade rate has an exponential fade profile.

60. The method of claim 55, further comprising:

causing the light intensity level of the at least one lamp to fade at the second fade rate for a predefined long fade time.

61. The method of claim 60, further comprising:

causing the light intensity level of the at least one lamp to fade to off at a third fade rate after the long fade time elapses.

62. The method of claim 61, wherein the third fade rate is a predefined rate for causing the light intensity level to fade from 100% to off over a predefined amount of time.

63. The method of claim 55, further comprising:

causing the light intensity level of the at least one lamp to fade to off at a third fade rate upon a determination that the switch controller has been actuated for only a transitory duration.

64. The method of claim 63, wherein the third fade rate is faster than the second fade rate.

65. A method for controlling a light intensity level of at least one lamp, the at least one lamp having an initial light intensity level, the method comprising:

determining that a switch controller has been actuated;

causing the light intensity level of the at least one lamp to fade at a first fade rate upon a determination that the switch controller is actuated and at a second fade rate upon a determination that the switch controller has been actuated for at least a predefined actuator hold time, wherein the first fade rate is based on a predefined fade-off time that is longer than the predefined actuator hold time.

66. The method of claim 65, wherein the first fade rate is based on a predefined fade-off time, the fade-off time representing a time duration allotted for fading the light intensity level of the at least one lamp from the initial intensity level to off.

67. The method of claim 65, wherein the first fade rate is based on a predefined fade-off time that is longer than the predefined actuator hold time.

68. The method of claim 65, wherein the second fade rate is slower than the first fade rate.

69. The method of claim 65, wherein the second fade rate has an exponential fade profile.

70. The method of claim 65, further comprising:

causing the light intensity level of the at least one lamp to fade at the second fade rate for a predefined long fade time.

71. The method of claim 70, further comprising:

causing the light intensity level of the at least one lamp to fade to off at a third fade rate after the long fade time elapses.

72. The method of claim 71, wherein the third fade rate is a predefined rate for causing the light intensity level to fade from 100% to off over a predefined amount of time.

73. The method of claim 65, further comprising:

causing the light intensity level of the at least one lamp to fade to off at a third fade rate upon a determination that the switch controller has been actuated for only a transitory duration.

74. The method of claim 73, wherein the third fade rate is faster than the second fade rate.

75. A computer-readable medium having stored thereon computer-executable instructions for performing a method for controlling a light intensity level of at least one lamp, the at least one lamp having an initial light intensity level, the method comprising:

determining that a switch controller has been actuated;

causing the light intensity level of the at least one lamp to fade at a first fade rate that is based on the initial intensity level of the at least one lamp; and causing the light intensity level of the at least one lamp to fade at a second fade rate upon a determination that the switch controller has been actuated for at least a predefined actuator hold time.

76. A computer-readable medium having stored thereon computer-executable instructions for performing a method for controlling a light intensity level of at least one lamp, the at least one lamp having an initial light intensity level, the method comprising:

determining that a switch controller has been actuated;

causing the light intensity level of the at least one lamp to fade at a first fade rate that is based on a predefined fade-off time, the fade-off time representing a time duration allotted for fading the light intensity level of the at least one map from the initial light intensity level to off;

causing the light intensity level of the at least one lamp to fade at a second fade rate upon a determination that the switch controller has been actuated for at least a predefined actuator hold time.

77. A computer-readable medium having stored thereon computer-executable instructions for performing a method for controlling a light intensity level of at least one lamp, the at least one lamp having an initial light intensity level, the method comprising:

determining that a switch controller has been actuated;

causing the light intensity level of the at least one lamp to fade at a first fade rate when the switch controller is actuated and at a second fade rate upon a determination that the switch controller has been actuated for at least a predefined actuator hold time, wherein the first fade rate is based on a predefined fade-off time that is longer than the predefined actuator hold time.

78. A method for controlling a light intensity level of at least one lamp, the at least one lamp having an initial light intensity level, the method comprising:

determining that a switch controller has been actuated;

causing, upon a determination that the switch controller has been actuated, the light intensity level of the at least one lamp to fade at a first fade rate that is based on the initial light intensity level of the at least one lamp;

causing, upon a determination that the switch controller has been actuated for only a single transitory duration, the light intensity level of the at least one lamp to fade to off at a second fade rate;

causing, upon a determination that the switch controller has been actuated for two successive transitory durations, the light intensity level of the at least one lamp to fade from the initial intensity level to a preset desired intensity level at a third fade rate; and causing, upon a determination that the switch controller has been actuated for more than a transitory duration, the light intensity level of the at least one lamp to fade to off in a predetermined fade rate sequence.

* * * * *